United States Patent [19]

Moeller et al.

[11] Patent Number: 4,591,419

[45] Date of Patent: May 27, 1986

[54] PROTECTIVE BARRIER FOR ALUMINA REDUCTION CELLS

[75] Inventors: Jerris C. Moeller, Franklin County, N.Y.; Douglas V. Stewart, Florence; Alton T. Tabereaux, Sheffield, both of Ala.

[73] Assignee: Reynolds Metals Company, Richmond, Va.

[21] Appl. No.: 772,541

[22] Filed: Sep. 4, 1985

[51] Int. Cl.[4] ..... C25C 3/08

[52] U.S. Cl. ..... 204/243 R; 204/67; 204/279

[58] Field of Search ..... 204/67, 243 R–247, 204/279

[56] References Cited

U.S. PATENT DOCUMENTS 3,773,643 11/1973 Russell et al. ..... 204/243 R
3,779,699 12/1973 Russell et al. ..... 432/248
4,119,422 10/1978 Rostoker ..... 204/243 R
4,160,715 7/1979 Kinosz et al. ..... 204/243 R
4,411,758 10/1983 Hess et al. ..... 204/243 R

FOREIGN PATENT DOCUMENTS 6905907 4/1969 Netherlands ..... 204/243 R

*Primary Examiner*—John F. Niebling
*Assistant Examiner*—Terryence Chapman
*Attorney, Agent, or Firm*—Alan T. McDonald

[57] ABSTRACT

A protective barrier for alumina reduction cell cathodes is disclosed. This barrier layer comprises a layer of borosilicate glass which may optionally be surrounded by layers of alumina silicate glass. The barrier prevents cryolitic salts from attacking the reduction cell insulation, preventing degradation of the insulation and improving cell efficiency.

11 Claims, 1 Drawing Figure

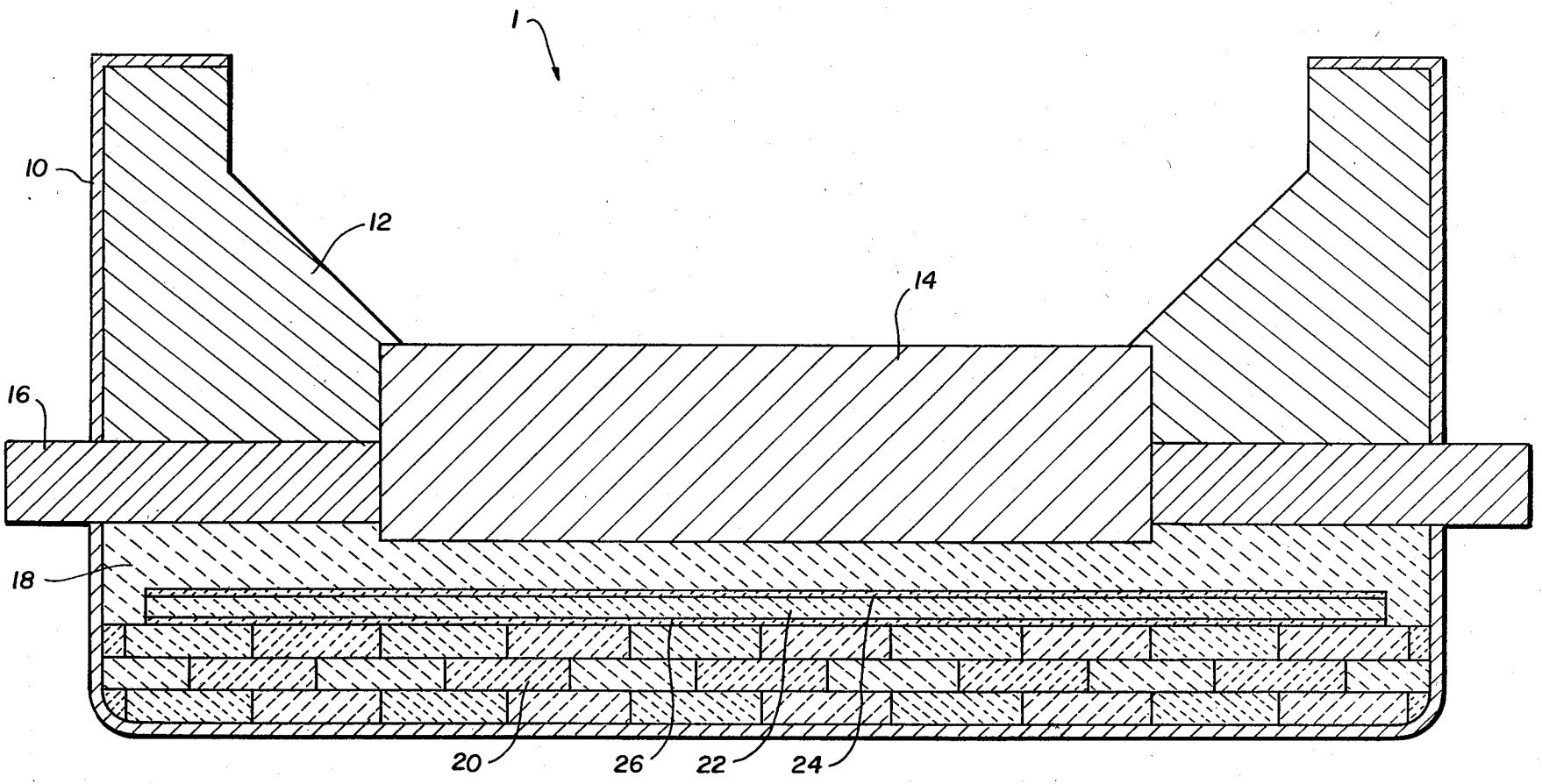
1
10
12
14
16
18
20
22
24
26

PROTECTIVE BARRIER FOR ALUMINA REDUCTION CELLS

BACKGROUND OF THE INVENTION

Reduction cells for reducing alumina to aluminum require adequate insulation in the cathode to limit heat losses from the steel shell surrounding the cathode during cell operation. Cryolitic salts and vapors, containing an excess of sodium fluoride, penetrate through the carbonaceous cathode lining and chemically attack and degrade the thermal insulation in the bottom of the cathode shell. As the insulation is degraded, the insulation loses its effectiveness as a thermal insulation material and heat losses through the insulation increase. As a consequence, the cell voltage must often be increased in order to maintain a stable thermal equilibrium in the cell. If this is not done, the temperature of the electrolyte decreases, resulting in increases in anode effects and/or reduced interelectrode distance in the cell. Either of these consequences results in reduced productivity and/or increased operating costs for the cell.

The highly corrosive cryolitic salt vapors penetrating through the cathode lining can be stopped in either of two ways. If the temperature isotherm through the insulation is maintained sufficiently low, i.e., less than about 600° C., to prevent any mobility and thereby any reactivity of the salts above their freezing points, these salts do not migrate to the insulation layers. This is, however, an extremely inefficient way to operate an alumina reduction cell, and thus the benefits to be gained by prohibiting cryolitic salt vapor penetration to the insulation are more than offset by other system inefficiencies.

The other alternative method to protect alumina reduction cell insulation from cryolitic salt vapors is by means of a physical barrier material. This barrier is positioned above the low temperature insulation material and beneath higher temperature insulation material which is in contact with the carbon cathode and cell bottom wall. Numerous materials have been tried in the past as a barrier layer, with the most common material being a steel plate. It is difficult, however, to obtain a unitary steel plate of a size sufficient to cover an alumina reduction cell and gaps between steel plates which are laid next to one another to form a sufficient size barrier layer provide regions for vapor penetration.

In U.S. Pat. No. 4,411,758 a low softening point glass, such as soda-lime glass, typically in the form of cullet, is disclosed as a physical barrier layer for alumina reduction cells. It has been found, however, that such a soda-lime glass layer is ineffective as a barrier material in resisting cryolitic salts and vapors in reduction cell cathodes. Its chemical reactivity, due to its chemical composition, and its relatively low softening point, flow point and surface tension, make this material difficult to contain in the alumina reduction cell at normal operating temperatures, i.e., at or above about 900° C., during cell operation as well as providing less than desired protection for the insulation material.

There remains a need, therefore, to provide a reliable alumina reduction cell barrier material.

THE PRESENT INVENTION

By means of the present invention, this desired goal has now been obtained. The present invention comprises a barrier layer for an alumina reduction cell which comprises borosilicate glass. The borosilicate glass is preferably provided as cullet, or other ground glass, and during start-up of the cell, softens and fuses into a continuous plastic layer, thereby forming a non-rigid, conformable barrier when the cell reaches its operating temperature. The semi-liquid, plastic glass layer will either react or fuse with the cryolitic salt and vapors to form higher melting temperature compounds, which will convert the temporary plastic glass barrier into a permanent rigid barrier, or the cryolitic salts and vapors will not react with the glass due to the immiscible, insoluability of the components involved. In the latter case, a high glass viscosity is desirable to increase and/or maintain the immiscibility of the components.

BRIEF DESCRIPTION OF THE DRAWING

The present invention will be more fully described with reference to the FIGURE which is a cross-sectional view of an alumina reduction cell cathode employing the barrier layer of the present invention.

DETAILED DESCRIPTION OF THE PREFERRED EMBODIMENT

Turning now to the FIGURE, an alumina reduction cell cathode 1 is shown in cross section. The cell 1 includes a generally rectangular shaped open top steel shell 10, one or more layers 20 of low temperature refractory insulation, a layer 18 of high temperature refractory insulation, insulation barrier 22, surrounded by optional barrier layers 24 and 26, a layer of prebaked and/or monolithic rammed carbon 12 on the bottom and sidewalls of cell 1, a carbonaceous cathode 14 and bus bars 16 which connect the cathode 14 to a source of electric current.

High temperature insulation layer 18 may be formed from such materials as metalurgical powder alumina or refractory brick, and is typicially formed as a monolithic unit. Low temperature insulation 20 may be formed as a monolithic unit, or may be formed from one or more layers of refractory blocks, formed from such materials as vermiculite or calcium silicate slabs, or insulating bricks.

The barrier layer 22 is formed from a borosilicate glass. The borosilicate glass is preferably supplied as ground glass or cullet, typically providing a layer of between about 0.5 and about 3.0 inches (1.270 and 7.620 centimeters) and, during start-up of the cell, softens and fuses into a monolithic layer 22. The borosilicate glass layer 22 may have a composition comprising $SiO_2$ about 65 to about 85
$Na_2O$ about 3.5 to about 6.5
$K_2O$ about 0 to about 1
$B_2O_3$ about 5 to about 30
$Al_2O_3$ about 0 to about 6 on a percent by weight basis and may have the following physical properties:

Softening Point, °C. about 750 to about 825
Flow Point, °C. about 900 to about 1100
Density, g/cc about 2.1 to about 2.3
Surface Tension, Dynes/cm about 345 to about 350

The borosilicate glass may be, for example, a Pyrex® glass. The borosilicate glass is effective as a barrier to the cryolitic salts and vapors due to its chemical composition and higher softening point and flow point than soda-lime glass. The boric oxide in borosilicate glass has less effect than soda in lowering the viscosity of the silica and requires higher melting temperatures than soda-lime glass. Borosilicate glass has a good resistance to the corrosive effects of acids.

Thus, for example, the borosilicate glass has a softening point aproximately 50° to 100° C. higher than that of soda-lime glass and has flow point substantially higher than the operating temperature of an alumina reduction cell. Further, the surface tension of borosilicate glass is in excess of that of soda-lime glass, aiding in the physical barrier abilities of the borosilicate glass.

Also illustrated in the FIGURE are a pair of optional alumina silicate blankets 24 and 26. While required for soda-lime glass barriers, such as those illustrated in U.S. Pat. No. 4,411,758, in order to sufficiently wet the soda-lime glass, these layers are optional in the barrier system of the present invention. When present, however, they are typically in the form of an alumina silicate fiber paper and each have a thickness ranging between about 0.125 and about 0.250 inches (0.318 and 0.635 centimeters).

EXAMPLES

In order to compare the borosilicate glass barrier of the present invention with a soda-lime glass barrier as taught in U.S. Pat. No. 4,411,758, an alumina reduction cell was constructed having coupons imbedded therein at the location illustrated in the FIGURE for layer 22 as follows:

| EXAMPLE NO. | MATERIAL |
|---|---|
| 1 | a 1" thick layer of borosilicate cullet |
| 2 | a 1" thick layer of borosilicate cullet |
| 3 | a 1" thick layer of soda-lime cullet |
| 4 | a 1" thick layer of soda-lime cullet |

The alumina reduction cell was operated for a thirteen-month period, at which time the cell was disassembled and the coupons inspected. The results of the examples are as follows:

| EXAMPLE NO. | RESULTS |
|---|---|
| 1 | a ⅛ to ¼ thick, continuous glass barrier was intact |
| 2 | a ¼ to ⅜ thick, continuous glass barrier was intact |
| 3 | the glass was reacted and dispersed as globules in the cryolitic salts |
| 4 | the glass was reacted and dispersed as globules in the cryolitic salts |

-continued

It is clear from these Examples that while the borosilicate glass barriers of the present invention withstood the rigors of an operating alumina reduction cell for the test period, the soda-lime glass barriers were unable to function over the life of the cell.

From the foregoing, it is clear that the present invention provides an improved barrier system for protection of thermal insulation in an alumina reduction cell.

While the invention has been described with reference to certain specific embodiments thereof, it is not intended to be so limited thereby, except as set forth in the accompanying claims.

We claim:

1. In a reduction cell for producing aluminum in which alumina is dissolved in cryolite and electrochemically reduced to aluminum comprising an anode and a cathode, said cathode comprising a steel outer shell, first and second insulation layers on the floor and within said shell, a carbonaceous cathode on said first and second insulation layers, carbonaceous sidewalls within said shell and a barrier layer positioned between said first and said second insulation layers the improvement wherein said barrier layer comprises borosilicate glass which softens and fuses into a monolithic layer during start-up of said cell and which has a flow point higher than the operating temperature of said cell.

2. The cell of claim 1 wherein said borosilicate glass is initially supplied in the form of cullet.

3. The cell of claim 1 wherein said borosilicate glass comprises, on a weight percent basis, about 65 to about 85 percent $SiO_2$, about 3.5 to about 6.5 percent $Na_2O$, about 0 to about 1 percent $K_2O$, about 5 to about 30 percent $B_2O_3$ and about 0 to about 6 percent $Al_2O_3$.

4. The cell of claim 3 wherein said borosilicate glass has a softening point between about 750° and about 825° C.

5. The cell of claim 3 wherein said borosilicate glass has a flow point between about 900° and about 1100° C.

6. The cell of claim 3 wherein said borosilicate glass has a density between about 2.1 and about 2.3 g/cc.

7. The cell of claim 3 wherein said borosilicate glass has a surface tension between about 345 and about 350 dynes/cm.

8. The cell of claim 3 wherein said borosilicate glass layer is initially supplied at a thickness between about 0.5 and about 3.0 inches (1.270 and 7.620 centimeters).

9. The cell of claim 1 wherein said barrier layer further comprises a pair of alumina silicate blankets surrounding said borosilicate glass.

10. The cell of claim 9 wherein said alumina silicate blankets comprise alumina silicate fiber paper.

11. The cell of claim 9 wherein said alumina silicate blankets each have a thickness between about 0.125 and about 0.250 inches (0.318 and 0.635 centimeters).

* * * * *